US009656287B2

(12) United States Patent
Conner et al.

(10) Patent No.: US 9,656,287 B2
(45) Date of Patent: May 23, 2017

(54) HANDHELD VALVE DISPENSERS AND RELATED METHODS

(71) Applicant: Nordson Corporation, Westlake, OH (US)

(72) Inventors: Scott A. Conner, Foxboro, MA (US); Warren N. Strong, Suwanee, GA (US)

(73) Assignee: Nordson Corporation, Westlake, OH (US)

( * ) Notice: Subject to any disclaimer, the term of this patent is extended or adjusted under 35 U.S.C. 154(b) by 42 days.

(21) Appl. No.: 14/718,416

(22) Filed: May 21, 2015

(65) Prior Publication Data

US 2016/0339463 A1 Nov. 24, 2016

(51) Int. Cl.

| | |
|---|---|
| ***B05B 11/00*** | (2006.01) |
| ***B05C 17/005*** | (2006.01) |
| *B05C 5/02* | (2006.01) |
| *B05C 11/10* | (2006.01) |

(52) U.S. Cl.

CPC .. *B05C 17/00586* (2013.01); *B05C 17/00573* (2013.01); *B05C 5/0237* (2013.01); *B05C 11/1034* (2013.01)

(58) Field of Classification Search

CPC . B05B 11/0064; B05B 11/0072; B05B 11/06; B05B 5/747; B05C 11/1034; B05C 17/00573; B05C 17/00586; B05C 5/0237

See application file for complete search history.

(56) References Cited

U.S. PATENT DOCUMENTS

| | | | | |
|---|---|---|---|---|
| 3,967,784 | A * | 7/1976 | Ammon | E01C 23/166 239/583 |
| 4,068,663 | A * | 1/1978 | D'Alessandro | A61M 3/0262 222/541.9 |
| 4,440,316 | A * | 4/1984 | Christine | B65D 47/248 222/183 |
| 5,074,443 | A | 12/1991 | Fujii et al. | |
| 5,146,904 | A * | 9/1992 | Olson | F02M 67/12 123/531 |
| 5,263,608 | A * | 11/1993 | Kiernan | A24C 5/24 118/688 |

(Continued)

OTHER PUBLICATIONS

Nordson EFD, Engineered Fluid Dispensing™, The Optimum™ Cartridge System, Brochure, 8 pgs., 2010.

(Continued)

*Primary Examiner* — Frederick C Nicolas
*Assistant Examiner* — Bob Zadeh
(74) *Attorney, Agent, or Firm* — Baker & Hostetler LLP

(57) ABSTRACT

A handheld valve dispenser includes a barrel having proximal and distal ends and a fluid chamber adapted to store a fluid. A dispense tip is coupled to the distal end of the barrel and includes a piercing element and a valve seat. The piercing element is configured to pierce the seal and establish an aperture therethrough when the dispense tip is first coupled to the barrel. A valve stem is received within the fluid chamber and is movable between a closed position in which the valve stem sealingly contacts the valve seat to prevent fluid dispense, and an open position for dispensing fluid. The barrel may include an outer barrel member and a disposable inner barrel liner removably received within the outer barrel member.

39 Claims, 7 Drawing Sheets

(56) References Cited

U.S. PATENT DOCUMENTS

| | | | | |
|---|---|---|---|---|
| 5,429,273 | A * | 7/1995 | King | B05B 11/0043 222/105 |
| 5,743,442 | A * | 4/1998 | Barbe | D06F 39/022 222/382 |
| 8,272,537 | B2 | 9/2012 | Varga | |
| 8,701,906 | B1 * | 4/2014 | Anderson | B65D 41/20 206/220 |
| 8,753,713 | B2 | 6/2014 | Clark et al. | |
| 2010/0167899 | A1 * | 7/2010 | Carr | B04B 7/12 494/4 |
| 2010/0213217 | A1 | 8/2010 | Strong et al. | |
| 2014/0048557 | A1 * | 2/2014 | Barron | B65D 5/748 222/81 |
| 2014/0117045 | A1 | 5/2014 | Varga | |

OTHER PUBLICATIONS

Nordson EFD, Engineered Fluid Dispensing™, Optimum® The Standard in Fluid Dispensing, Brochure, 8 pgs., 2014.

Nordson EFD, Hand-Operated Dispense Valves, Brochure, 8 pgs., 2012.

* cited by examiner

HANDHELD VALVE DISPENSERS AND RELATED METHODS

TECHNICAL FIELD

The present invention relates generally to fluid dispensers, and more particularly, to handheld valve dispensers.

BACKGROUND

Fluid dispensers are widely used for dispensing various types of fluids, such as liquid adhesives. Valve dispensers include actuatable valve stems for controlling fluid flow and are often employed in industrial applications requiring fluid to be dispensed with a high degree of control and efficiency. For example, in advanced applications, such valve dispensers may be incorporated into automated systems in which the positioning and actuation of the valve dispenser is automatically controlled. In other applications, valve dispensers may be designed for handheld use, where the user may grip the dispenser with his or her hand and physically position the dispenser as desired relative to a surface to be dispensed upon.

Known handheld valve dispensers include mechanically actuated components for controlling the rate at which fluid is dispensed. However, manual actuation of such components by a user may result in fluid being dispensed with inadequate precision. Furthermore, known handheld valve dispensers often exhibit inconsistencies in dispensing performance caused by the escape of air entrapped within the fluid as the fluid is dispensed. Such air escape often results in unpredictable variation in the volume and rate at which fluid is dispensed.

Additionally, various components of known handheld valve dispensers are often discarded and replaced by users following one or more uses. Because the components of such dispensers are often formed with robust structure through injection molding and/or machining processes, disposal of such components is wasteful and manufacture of replacement components can be costly, which results in significant financial burdens for the end user.

Accordingly, there is a need for a handheld valve dispenser with improved dispensing capabilities and having disposable components that are more cost-effective to manufacture and replace.

SUMMARY

A handheld valve dispenser according to an exemplary embodiment includes a barrel having a proximal end, a distal end having a seal, and a fluid chamber extending between the proximal and distal ends and adapted to store a fluid. A dispense tip is coupled to the distal end of the barrel and includes a piercing element and a valve seat. The piercing element is configured to pierce the seal and establish an aperture therethrough when the dispense tip is first coupled to the barrel. A valve stem is received within the fluid chamber and is movable between a closed position in which the valve stem sealingly contacts the valve seat to prevent fluid from being dispensed, and an open position in which the valve stem is spaced from the valve seat to allow fluid to be dispensed through the dispense tip.

In another exemplary embodiment, a dispense tip is provided for use with a handheld valve dispenser. The handheld valve dispenser includes a barrel having a proximal end, a distal end having a seal, a fluid chamber extending between the proximal and distal ends, and a valve stem movable within the fluid chamber between a closed position to prevent fluid from being dispensed and an open position to allow fluid to be dispensed through the dispense tip. The dispense tip includes a piercing element configured to pierce the seal and establish an aperture therethrough when the dispense tip is first coupled to the barrel. The dispense tip further includes a valve seat configured to sealingly contact the valve stem in the closed position. The dispense tip further includes a tip needle configured to dispense the fluid.

A handheld valve dispenser according to another exemplary embodiment includes a disposable barrel liner having a proximal end, a distal end having a seal, and a fluid chamber extending between the proximal and distal ends and adapted to store a fluid and to receive a valve stem. The handheld valve dispenser further includes a dispense tip that is couplable to the disposable barrel liner and includes a piercing element configured to pierce the seal and establish an aperture therethrough when the dispense tip is first coupled to the disposable barrel liner.

A handheld valve dispenser according to yet another exemplary embodiment includes a barrel having a proximal end, a distal end, and a fluid chamber extending between the proximal and distal ends and adapted to store a fluid. A valve stem is received within the fluid chamber and is movable between a closed position in which the valve stem sealingly contacts a valve seat positioned proximate the distal end of the barrel to prevent fluid from being dispensed, and an open position in which the valve stem is spaced from the valve seat to allow fluid to be dispensed. A first air inlet is operatively coupled to the barrel and is configured to receive air for pressurizing the fluid chamber. A second air inlet is operatively coupled to the barrel and is configured to receive air for actuating the valve stem between the closed position and the open position.

A method according to an exemplary embodiment is provided for assembling a handheld valve dispenser including a barrel having a distal end provided with a seal and the barrel defining a fluid chamber adapted to store a fluid, a dispense tip having a piercing element and a valve seat, and a valve stem. The method includes inserting the valve member into the fluid chamber of the barrel. The method further includes coupling the dispense tip to the distal end of the barrel, and piercing the seal with the piercing element to establish an aperture through the seal. The method further includes sealingly contacting the valve seat with the valve stem.

A method according to another exemplary embodiment is provided for assembling a handheld valve dispenser including a disposable barrel liner having a distal end provided with a seal and the barrel defining a fluid chamber adapted to store a fluid and adapted to receive a valve stem. The handheld valve dispenser further includes a dispense tip having a piercing element. The method includes coupling the dispense tip to the distal end of the disposable barrel liner, and piercing the seal with the piercing element to establish an aperture through the seal. The method further includes maintaining the aperture in the seal so that the fluid in the fluid chamber may be dispensed through the dispense tip when the valve stem is provided in an open position.

A method according to yet another exemplary embodiment is provided for dispensing fluid with a handheld valve dispenser including a barrel having a fluid chamber adapted to store a fluid, a valve stem, a valve seat, a first air inlet, and a second air inlet. The method includes filling the fluid chamber with a fluid, and providing the valve stem in a closed position in which the valve stem sealingly contacts the valve seat to prevent the fluid from being dispensed. The method further includes receiving air through the first air inlet for pressurizing the fluid chamber. The method further includes receiving air through the second air inlet for actuating the valve stem to an open position in which the valve stem is spaced from the valve seat, and dispensing the fluid while the valve stem is in the open position.

Various additional features and advantages of the invention will become more apparent to those of ordinary skill in the art upon review of the following detailed description of one or more illustrative embodiments taken in conjunction with the accompanying drawings. The drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
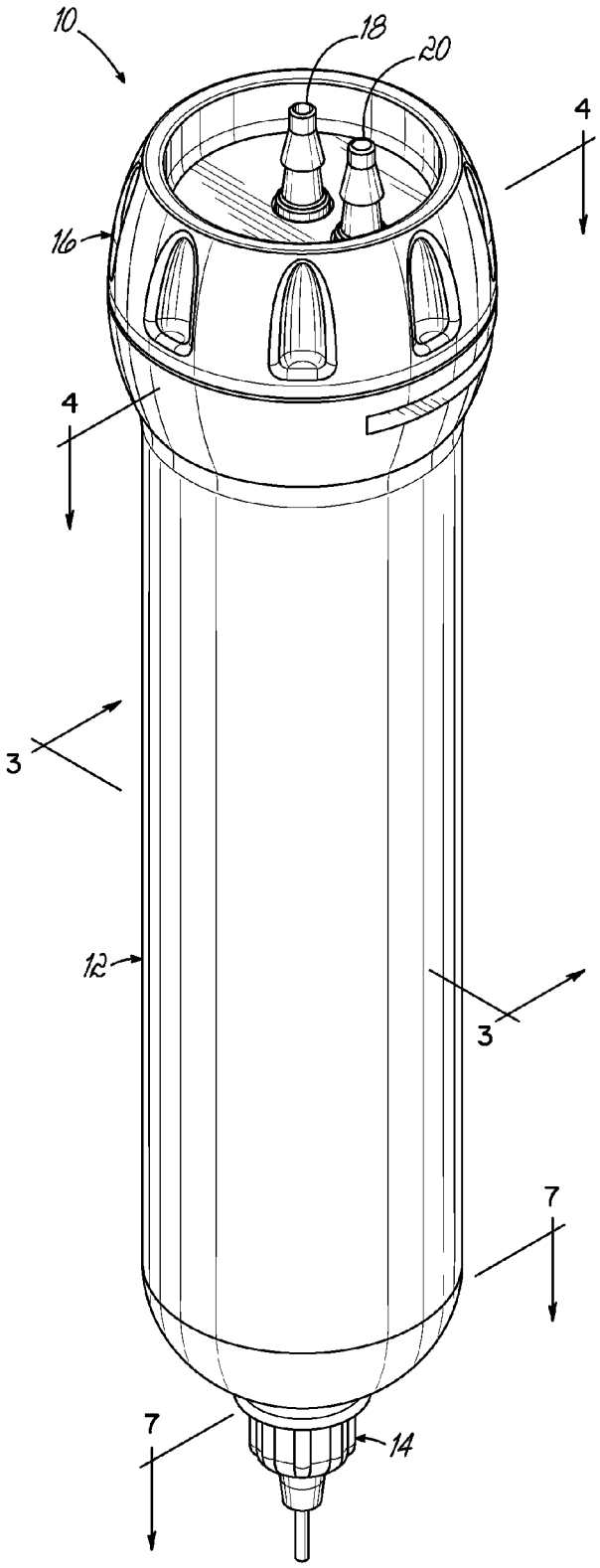
FIG. 1 is a perspective view of a handheld valve dispenser according to an embodiment of the invention.
Figure 2:
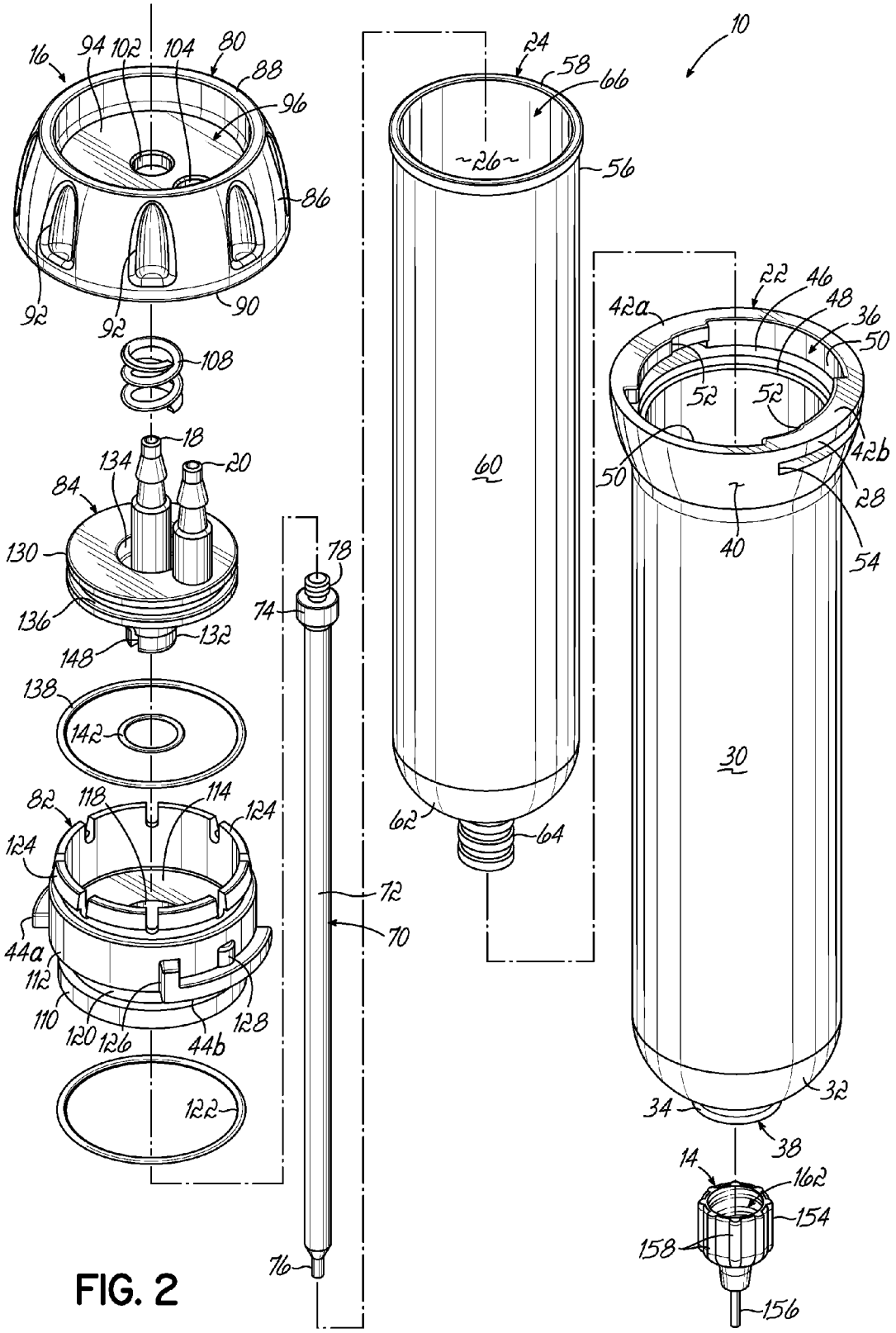
FIG. 2 is a disassembled, perspective view of the handheld valve dispenser of FIG. 1.
Figure 3:
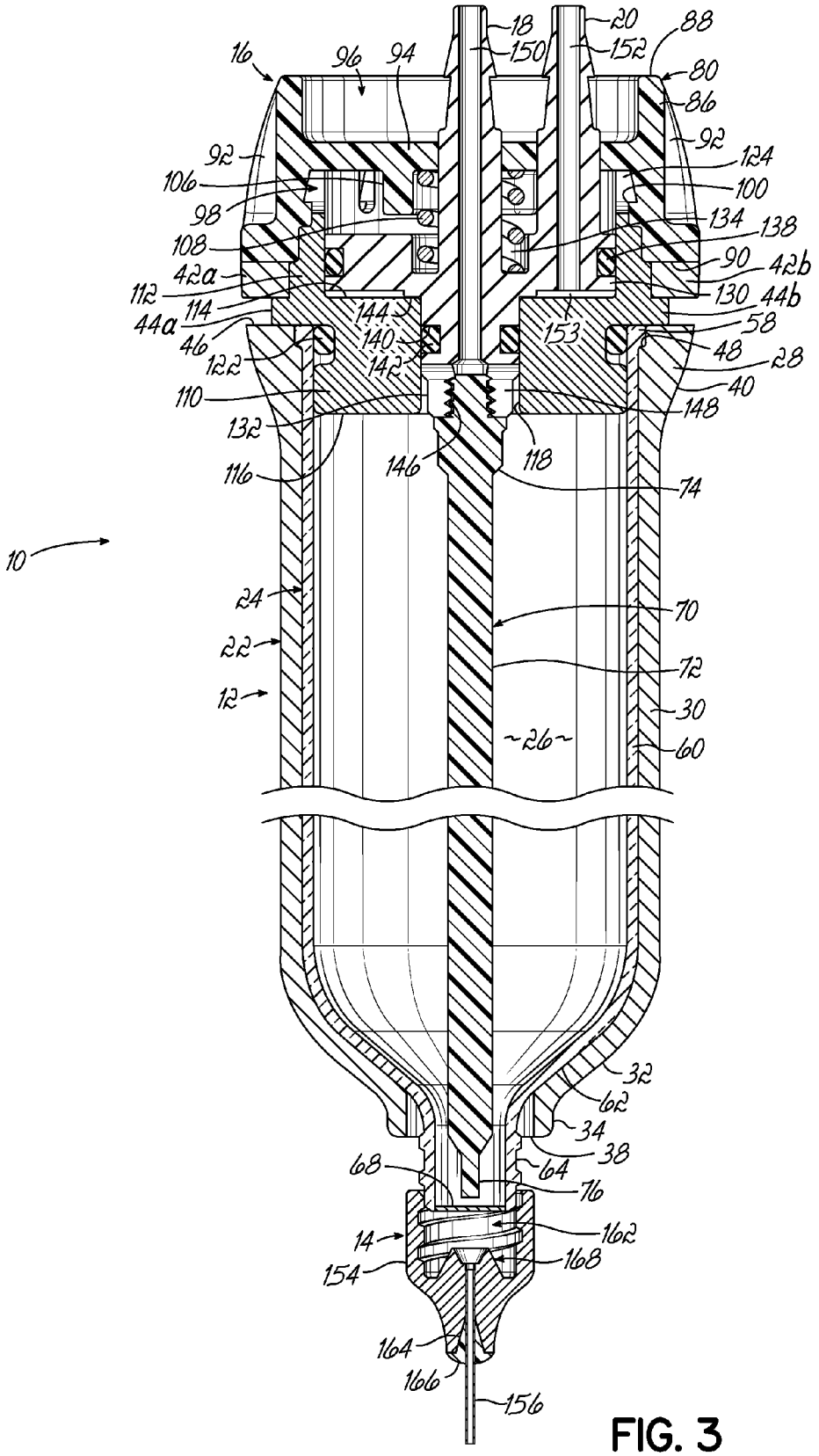
FIG. 3 is a side cross-sectional view of the handheld valve dispenser of FIG. 1, taken along section line 3-3, shown in a partially assembled configuration.

Referring to FIGS. 1-3, an exemplary handheld valve dispenser 10 in accordance with an embodiment of the invention is shown. The handheld valve dispenser 10 is configured for handheld use and for dispensing small volumes of a fluid, such as liquid adhesive. As shown in FIG. 1, the handheld valve dispenser 10 generally includes a barrel 12, a dispense tip 14 releasably coupled to a distal end of the barrel 12, and a closure 16 releasably coupled to a proximal end of the barrel 12 and housing a first air inlet fitting 18 and a second air inlet fitting 20.

Referring to FIGS. 2 and 3, additional features of the handheld valve dispenser 10 are shown. The barrel 12 includes an outer barrel member 22 and a disposable inner barrel liner 24 received within the outer barrel member 22 and defining a fluid chamber 26 adapted to store a fluid to be dispensed. The outer barrel member 22 includes a proximal closure portion 28 adapted to releasably engage the closure 16 and defining a proximal end of the outer barrel member 22. The outer barrel member 22 further includes a tubular medial portion 30 suitably sized and shaped to be gripped by a hand of a user, and a distal tapered portion 32 extending toward a distal collar 34 defining a distal end of the outer barrel member 22. The proximal closure portion 28 defines a proximal opening 36 sized to receive the disposable inner barrel liner 24 and a base portion of the closure 16 therethrough. The distal collar 34 defines a distal opening 38 sized to receive portions of the disposable inner barrel liner 24 and the dispense tip 14 therethrough, as shown best in FIG. 3. The outer barrel member 22 may be formed of any suitable plastic or metallic material, such as through injection molding or machining for example, and may be formed with a wall thickness adequate to provide the outer barrel member 22 with a structure suitably rigid and durable for repeated use.

The proximal closure portion 28 of the outer barrel member 22 includes a convex tapered outer surface 40, and a pair of diametrically opposed locking lips 42*a* and 42*b* configured to overlie and releasably engage a corresponding pair of locking wings 44*a* and 44*b* formed on the closure 16, as described below. Each locking lip 42*a*, 42*b* extends circumferentially and projects radially inward into the proximal opening 36 of the outer barrel member 22, and overlies an annular ledge 46. An annular rim 48 is positioned beneath the annular ledge 46 and is sized and shaped to receive the annular lip 58 of the disposable inner barrel liner 24. The locking lips 42*a*, 42*b* are independent from one another, and thus a circumferential gap 50 is defined between the locking lips 42*a*, 42*b* at each of their ends. Each locking lip 42*a*, 42*b* includes a detent depression 52. The proximal closure portion 28 further includes a pair of diametrically opposed circumferential slots 54 extending radially through a thickness of the proximal closure portion 28 beneath the locking lips 42*a*, 42*b* and opening to the annular ledge 46. In alternative embodiments, any suitable quantity and arrangement of locking lips 42*a*, 42*b*, locking wings 44*a*, 44*b*, and circumferential slots 54 may be provided.

The disposable inner barrel liner 24 includes a proximal portion 56 having an annular lip 58 defining a proximal end of the disposable inner barrel liner 24, a tubular medial portion 60, and a distal tapered portion 62 extending toward a distal neck 64. The proximal portion 56 defines a proximal opening 66 sized to receive a base portion of the closure 16 therethrough. The distal neck 64 defines a distal end of the disposable inner barrel liner 24 and includes a liner seal 68, shown in the form of a thin-walled circular membrane. The distal neck 64 may include an external thread for threadedly engaging a corresponding internal thread formed on the dispense tip 14. As shown in FIG. 3, the disposable inner barrel liner 24 may be formed with a wall thickness less than that of the outer barrel member 22.

The disposable inner barrel liner 24 is formed of a material and using methods that enable inexpensive manufacture of the disposable inner barrel liner 24. For example, the disposable inner barrel liner 24 may be formed of any suitable plastic material through a blow-molding process to yield a thin-walled structure using minimal materials. Accordingly, and advantageously, the disposable inner barrel liner 24 is provided with a thin-walled structure that is inexpensively manufactured, and thus may be discarded and replaced after one or more uses of the handheld valve dispenser 10 with minimal financial costs to the user and with minimal waste of materials.

The handheld valve dispenser 10 further includes a valve member 70 having a valve stem 72, a valve head 74 extending from a proximal end of the valve stem 72, and a valve tip 76 extending from a distal end of the valve stem 72. While the valve tip 76 is shown herein having a substantially cylindrical shape, any suitable alternative shapes may be used. The valve head 74 may include a threaded shaft 78 for threadedly engaging an air piston 84, as described below.

The closure 16 of the handheld valve dispenser 10 engages the proximal portions of the outer barrel member 22 and the disposable inner barrel liner 24. The closure 16 includes a closure cap 80 and a closure base 82 that receives the closure cap 80 in locking engagement, thereby defining a housing for an air piston 84 and the first and second air inlet fittings 18, 20. The closure cap 80 includes a circumferential outer wall 86 having a convex curvature and defining an upper annular surface 88 and a lower annular surface 90. The outer wall 86 includes a plurality of circumferentially spaced scallops 92, or recesses, extending radially inward through an outer surface of the outer wall 86, and which serve to enhance the ability of a user to grip the closure cap 80 during assembly and use. Each scallop 92 may include a tapered convex surface extending axially through the outer wall 86. The closure cap 80 also includes a circular central wall 94 extending radially at an axial location between the upper and lower annular surfaces 88, 90. The central wall 94 and the outer wall 86 together define an upper socket 96 and a lower socket 98, as best shown in FIG. 3.

The circumferential outer wall 86 of the closure cap 80 includes an annular rib 100, which may be segmented, that projects radially inward into the lower socket 98. The circular central wall 94 includes a first bore 102 for receiving the first air inlet fitting 18 therethrough, and a second bore 104 for receiving the second air inlet fitting 20 therethrough. As shown, the first bore 102 may extend along the central axis of the closure 16, while the second bore 104 is spaced radially from the first bore 102. An annular inner wall 106 extends axially from the central wall 94 into the lower socket 98 and defines a central pocket that receives an upper end of a coil compression spring 108. As shown in FIG. 3, the annular inner wall 106 may be discontinuous (e.g., may include a circumferentially extending gap) in order to accommodate the second air inlet fitting 20.

The closure base 82 includes a lower body 110 and an upper cylindrical wall 112 extending from the lower body 110. The lower body 110 includes an upper annular surface 114, a lower annular surface 116, and a bore 118 extending between the upper and lower annular surfaces 114, 116, the bore 118 being sized to receive a lower stem portion 132 of the air piston 84. The lower body 110 further includes an annular groove 120 that receives an annular seal 122. An upper end of the upper cylindrical wall 112 includes a plurality of circumferentially spaced upstanding coupling tabs 124, each having an outer edge adapted to biasingly engage and overlie the annular rib 100 of the closure cap 80 for coupling the closure cap 80 to the closure base 82.

The locking wings 44*a*, 44*b* extend radially outward from the upper cylindrical wall 112 of the closure base 82, and are configured to engage the locking lips 42*a*, 42*b* of the outer barrel member 22. Similar to the locking lips 42*a*, 42*b*, the locking wings 44*a*, 44*b* may be diametrically opposed. In alternative embodiments, any suitable quantity and arrangement of locking lips 42*a*, 42*b* and corresponding locking wings 44*a*, 44*b* may be provided. Each locking wing 44*a*, 44*b* extends circumferentially about the upper cylindrical wall 112 and may be slightly angled (e.g., helically) relative to the central axis of the handheld valve dispenser 10. Consequently, when the closure 16 is coupled to the outer barrel member 22 through rotation, as described below, the angled orientation of the locking wings 44*a*, 44*b* draws the closure 16 into increased axial engagement with the outer barrel member 22 as the closure is increasingly rotated.

Figure 4A:
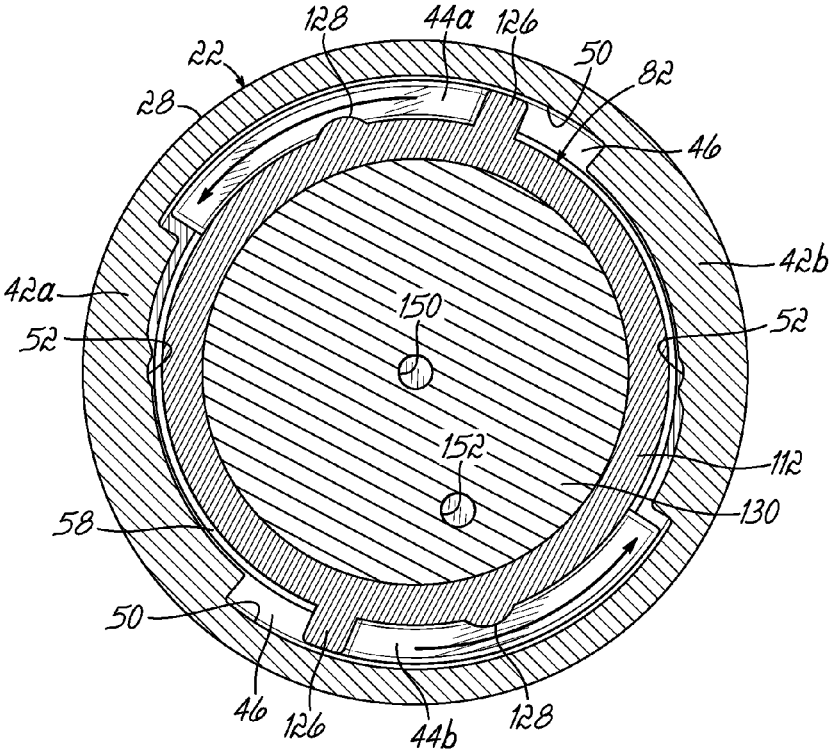
FIG. 4A is a top cross-sectional view of the handheld valve dispenser of FIG. 1, taken along section line 4-4, showing a closure in an unlocked position.
Figure 4B:
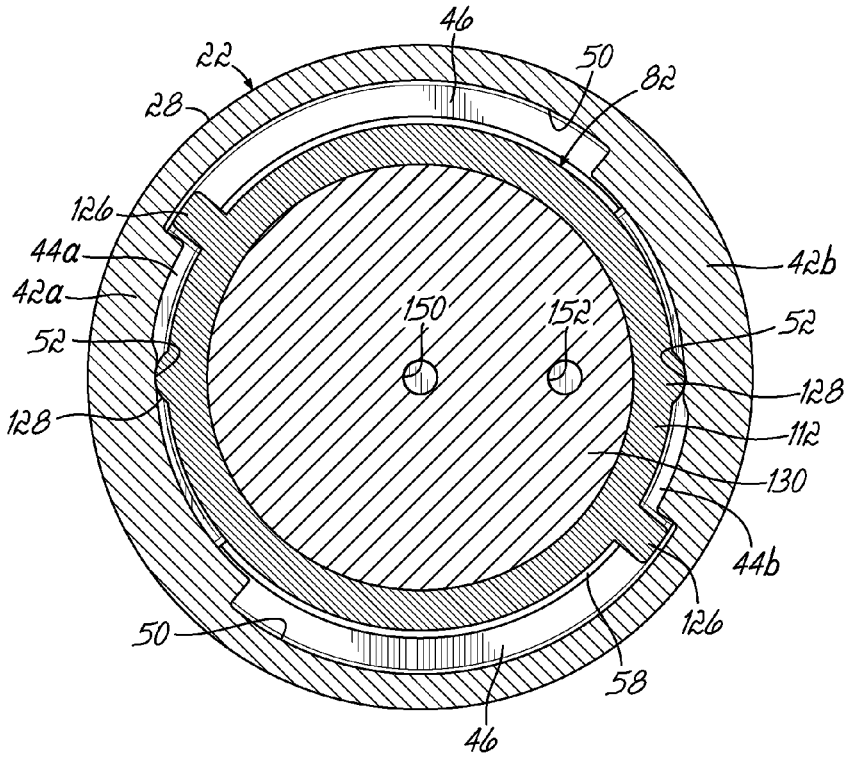
FIG. 4B is a top cross-sectional view similar to FIG. 4A, showing the closure after having been rotated into a locked position.

Each locking wing 44*a*, 44*b* further includes an axially projecting stop element 126 at an end thereof. Each stop element 126 is configured to abut a side surface of a respective locking lip 42*a*, 42*b* to limit rotation of the closure 16 relative to the outer barrel member 22. Each locking wing 44*a*, 44*b* further includes a detent protrusion 128 configured to engage a respective one of the detent depressions 52 formed on the locking lips 42*a*, 42*b* for releasably securing the closure 16 to the outer barrel member 22 in a locked position into which the closure is rotated, as shown in FIGS. 4A and 4B.

The closure 16 houses the air piston 84, shown best in FIGS. 2 and 3. The air piston 84 includes a disk-shaped piston body 130 and a lower stem portion 132 extending from a lower surface of the piston body 130. The first and second air inlet fittings 18, 20 extend from an upper surface of the piston body 130. As shown, the piston body 130, the lower stem portion 132, and the first and second air inlet fittings 18, 20 may be formed as a single unitary component.

The first air inlet fitting 18 extends from the piston body 130 along a central axis thereof, which aligns with the central axis of the handheld valve dispenser 10 and the valve stem 72 during assembly. The second air inlet fitting 20 is spaced radially outward from the first air inlet fitting 18. An annular recess 134 is formed around the first air inlet fitting 18 for receiving a lower end of the compression spring 108. An upper annular groove 136 is formed at an outer circumference of the piston body 130 for receiving an upper piston seal 138. A lower annular groove 140 is formed at an outer circumference of the lower stem portion 132 for receiving a lower piston seal 142. The upper and lower piston seals 138, 142 are shown in the form of o-rings. An annular shoulder 144 is formed on the piston body 130 at a base of the lower stem portion 132. The lower stem portion 132 includes a threaded bore 146 adapted to threadedly engage the threaded shaft 78 of the valve member 70. A stem slot 148 extends diametrically through the lower stem portion 132, including the threaded bore 146. A first air inlet passage 150 extends through the first air inlet fitting 18 and the lower stem portion 132, and opens to the threaded bore 146 and the stem slot 148. A second air inlet passage 152 extends through the second air inlet fitting 20 and opens to a lower surface of the piston body 130.

As shown in FIG. 3, the air piston 84 is received within the closure base 82 such that a lower surface of the piston body 130 confronts the upper annular surface 114 of the closure base 82. In particular, the annular shoulder 144 of the air piston 84 may be supported directly on the upper annular surface 114. The upper piston seal 138 forms an air-tight seal with an inner surface of the upper cylindrical wall 112 of the closure base 82. The lower stem portion 132 of the air piston 84 extends through the bore 118 of the closure base 82, and the lower piston seal 142 forms an air-tight seal with a wall of the bore 118. In this manner, an air chamber 153 is defined between the piston body 130 and the upper annular surface 114 of the closure base 82, and communicates with the second air inlet passage 152. As described below in connection with FIGS. 8A and 8B, the air piston 84 moves axially within and relative to the closure 16, and directs movement of the valve stem 72 between a raised position for dispensing fluid and a lowered position for blocking fluid from being dispensed.

As shown in FIGS. 2, 3, and 5A-7, the dispense tip 14 of the handheld valve dispenser 10 includes a tip hub 154 and a tip needle 156 coupled to the tip hub 154. An outer surface of the tip hub 154 includes a plurality of circumferentially spaced ridges 158 projecting radially and axially. As described below, the ridges 158 are adapted to engage a corresponding plurality of circumferentially spaced radial depressions 160 formed on an inner surface of the distal collar 34 of the outer barrel member 22. Any suitable quantity, size, shape, and arrangement of ridges 158, or other radial projections, and radial depressions 160 may be provided. Additionally, in alternative embodiments, the ridges 158 or other radial projections may be formed on the outer barrel member 22 while the radial depressions 160 are formed on the tip hub 154.

The tip hub 154 further includes a hub socket 162 sized to receive the distal neck 64 of the disposable inner barrel liner 24, and having an internal thread adapted to engage the external thread formed on the distal neck 64. A distal end of the tip hub 154 may include a tapered bore 164 through which the tip needle 156 is received during manufacture, and which may be fitted with a tapered plug 166 for stabilizing and securing the tip needle 156 relative to the tip hub 154.

The dispense tip 14 further includes a piercing element 168 extending axially from a base surface 170 of the hub socket 162. The piercing element 168 is generally frustoconical in shape and includes a tapered outer surface 172, an annular upper piercing edge 174, and a tapered cavity 176. The tapered cavity 176 may be generally inverted frustoconical in shape and opens to the hub socket 162 at its upper end and to the tip needle 156 at its lower end. Additionally, the tapered cavity 176 defines a valve seat 178 sized to sealingly contact the valve tip 76 of the valve member 70. For example, as shown in the Figures, the valve seat 178 defined by the tapered cavity 176 may be formed with a width, or diameter, substantially equal to a width, or diameter, of the valve tip 76. As described below, the piercing element 168 is adapted to pierce the liner seal 68 formed on the distal end of the disposable inner barrel liner 24 so that the fluid contained within the fluid chamber 26 may be dispensed through the dispense tip 14.

Referring to FIGS. 2-7, general assembly of the handheld valve dispenser 10 will now be described according to an embodiment. As shown best in FIGS. 2, 3, and 7, the components of the handheld valve dispenser 10 are arranged generally coaxially.

As shown in FIG. 3, the disposable inner barrel liner 24 is received within the outer barrel member 22 such that the annular lip 58 of the disposable inner barrel liner 24 is seated on the annular rim 48 of the outer barrel member 22. The distal neck 64 of the disposable inner barrel liner 24 extends through distal opening 38 of the outer barrel member 22, and beyond the distal end of the outer barrel member 22 such that the external thread on the distal neck 64 is exposed. As described above, the disposable inner barrel liner 24 remains sealed at its distal end, via the liner seal 68, prior to attachment of the dispense tip 14. The fluid chamber 26 of the disposable inner barrel liner 24 may be filled with a supply of fluid before or after the disposable inner barrel liner 24 is received within the outer barrel member 22.

Figure 5A:
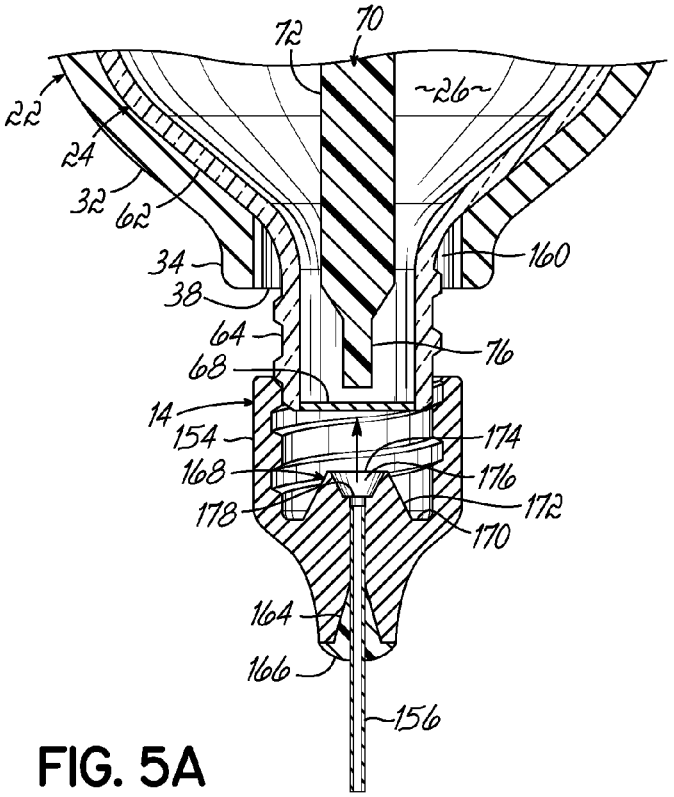
FIG. 5A is an enlarged cross-sectional view of the handheld valve dispenser of FIG. 3, showing the dispense tip prior to coupling with a distal end of a disposable inner barrel liner of the handheld valve dispenser.

After the valve member 70 is coupled to the lower stem portion 132 of the air piston 84, as described above, the closure 16 may be coupled to the barrel 12. In particular, as shown in FIG. 3, the valve member 70 and the lower body 110 of the closure base 82 are inserted into the fluid chamber 26 of the disposable inner barrel liner 24. The lower body 110 sealingly engages an inner surface of the disposable inner barrel liner 24 with the annular seal 122. Prior to attachment of the dispense tip 14, the liner seal 68 formed on the distal end of the disposable inner barrel liner 24 is intact and confronts the valve tip 76 of the valve member 70, as shown in FIGS. 3 and 5A.

Referring to FIGS. 3-4B, the closure 16 is rotatable relative to the barrel 12 between an unlocked position in which the closure 16 is freely separable from the barrel 12, shown in FIG. 4A, and a locked position in which the closure 16 is in a releasable locking engagement with the barrel 12, shown in FIGS. 3 and 4B.

In the unlocked position, the locking wings 44*a*, 44*b* of the closure 16 are received within the circumferential gaps 50 formed between the locking lips 42*a*, 42*b* of the outer barrel member 22, and are supported on the annular ledge 46. To achieve the locked position, the closure 16 may be rotated counter-clockwise, for example, relative to the barrel 12 so that the locking lips 42*a*, 42*b* overlie the locking wings 44*a*, 44*b*, and so that the detent protrusions 128 engage and seat within the corresponding detent depressions 52, as shown in FIG. 4B. Further rotation of the closure 16 beyond the locked position is hindered by the stop elements 126, which are provided substantially diametrically and which abut the ends of the locking lips 42*a*, 42*b* when the closure 16 is in the locked position. Additionally, the stop elements 126 may limit rotation of the closure 16 from the unlocked position to the locked position to a single direction. The closure 16 may be returned to the unlocked position by rotating the closure 16 in the opposite direction, such as clockwise, to disengage the detent protrusions 128 from the detent depressions 52 and realign the locking wings 44*a*, 44*b* with the circumferential gaps 50, as shown in FIG. 4A.

It will be understood that the degree of rotation through which the closure 16 is rotated between the unlocked and locked positions is determined by several factors. Such factors include the quantity and size of the locking wings 44*a*, 44*b* and the locking lips 42*a*, 42*b*, as well as the positioning of the detent protrusions 128 and the detent depressions 52. In the illustrated embodiment, the closure 16 is rotated through approximately 90 degrees between the locked and unlocked positions. In alternative embodiments, the locking wings 44*a*, 44*b*, locking lips 42*a*, 42*b*, detent protrusions 128, and detent depressions 52, may be provided in any suitable quantity, size, and arrangement to achieve any suitable configuration of one or more locked positions and one or more unlocked positions.

Engagement and disengagement of the detent protrusions 128 with the detent depressions 52 provides a tactile indication to the user as the closure 16 rotates into and out of the locked position. Further, the circumferential slots 54 formed in the outer barrel member 22 provide a visual indication of the position of the closure 16 relative to the locked and unlocked positions. In particular, in the locked position the locking wings 44*a*, 44*b* are visible through the circumferential slots 54, as shown in FIG. 3. In the unlocked position, the locking wings 44*a*, 44*b* are substantially not visible through the circumferential slots 54.

Referring to FIGS. 5A-7, attachment of the dispense tip 14 to the barrel 12 will now be described. The tip hub 154 is aligned coaxially with, and then rotated to threadedly engage, the distal neck 64 of the disposable inner barrel liner 24. As the tip hub 154 is rotated into increased threaded engagement with the distal neck 64, the piercing element 168 advances axially toward and pierces the liner seal 68 with the upper piercing edge 174, thereby forming an aperture through the liner seal 68, as shown in FIG. 5B. The pierced liner seal 68 is supported by the tapered outer surface 172 of the piercing element 168, thereby maintaining the formed aperture.

Figure 6:
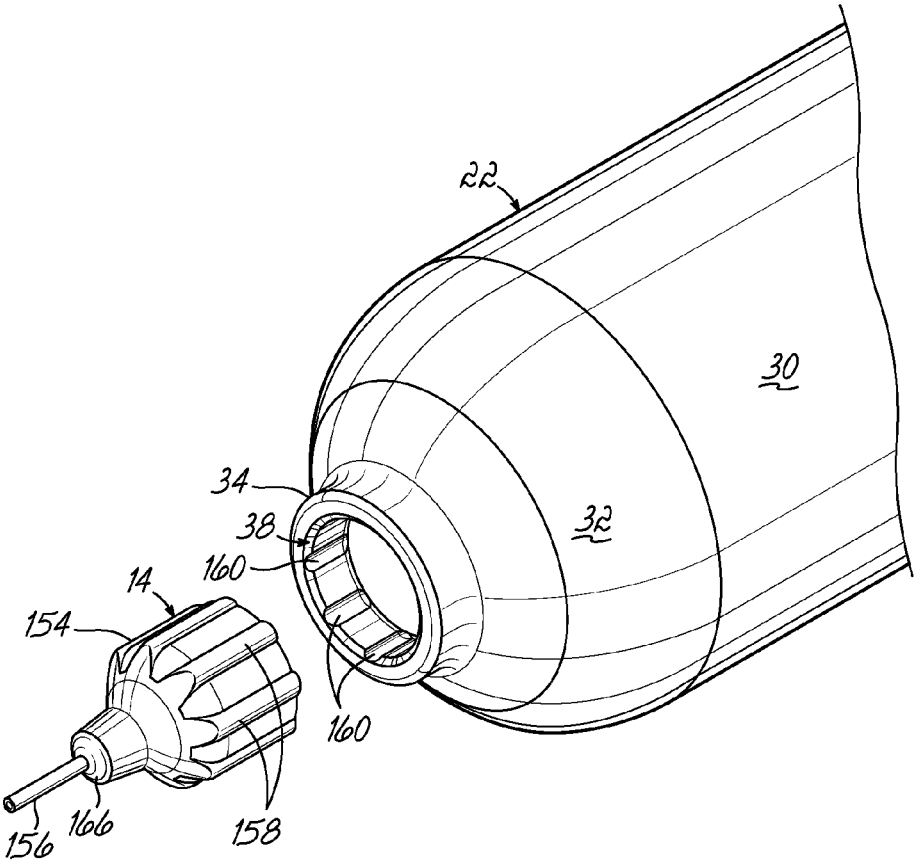
FIG. 6 is a partial perspective view of an outer barrel member and the dispense tip of the handheld valve dispenser of FIG. 1.

As the dispense tip 14 is fully threaded onto the distal neck 64, the ridges 158 provided on the outer surface of the tip hub 154 releasably engage the corresponding radial depressions 160 provided on the inner surface of the distal collar 34 of the outer barrel member 22, as shown in FIG. 6. The tip hub 154 may be formed of any suitable material, such as a plastic, having an elasticity sufficient to enable the tip hub 154 to slightly elastically deform as the ridges 158 engage the radial depressions 160. Accordingly, the ridges 158 and radial depressions 160 function as a detent-like feature. The releasable engagement of the ridges 158 with the radial depressions 160 hinders rotation of the dispense tip 14 relative to the barrel 12, including the outer barrel member 22 and the disposable inner barrel liner 24, thereby securing the dispense tip 14 rotationally during use.

Figure 5B:
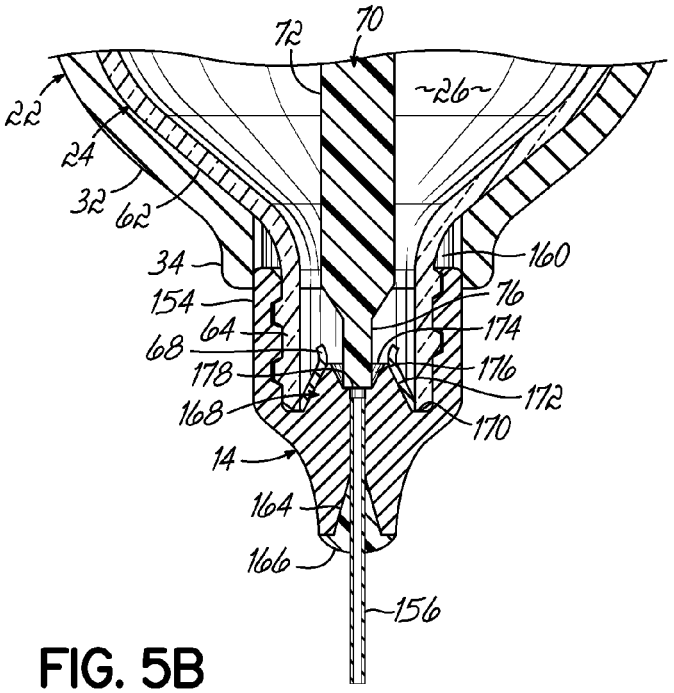
FIG. 5B is an enlarged cross-sectional view similar to FIG. 5A, showing the dispense tip coupled to the distal end of the disposable inner barrel liner and a piercing element piercing a seal formed on the distal end of disposable inner barrel liner.
Figure 7:
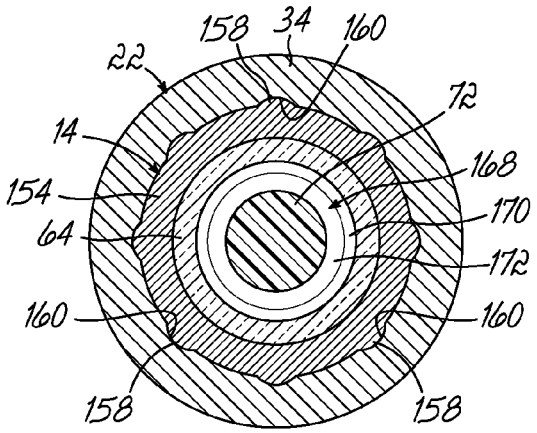
FIG. 7 is a top cross-sectional view of the handheld valve dispenser of FIG. 1, taken along section line 7-7.

As shown in FIG. 5B, when the dispense tip 14 is fully threaded onto the distal neck 64 of the disposable inner barrel liner 24, the piercing element 168 extends through the aperture formed in the pierced liner seal 68, and the valve tip 76 sealingly contacts the valve seat 178 formed on the piercing element 168. In this lowered closed position of the valve member 70, fluid stored in the fluid chamber 26 is blocked from flowing into the dispense tip 14 for dispensing until the valve member 70 is raised. The handheld valve dispenser 10 is now fully assembled and ready for operation. The cross-sectional view of FIG. 7 shows the coaxial arrangement of the multiple components of the assembled handheld valve dispenser 10.

Figures 8A, 8B:
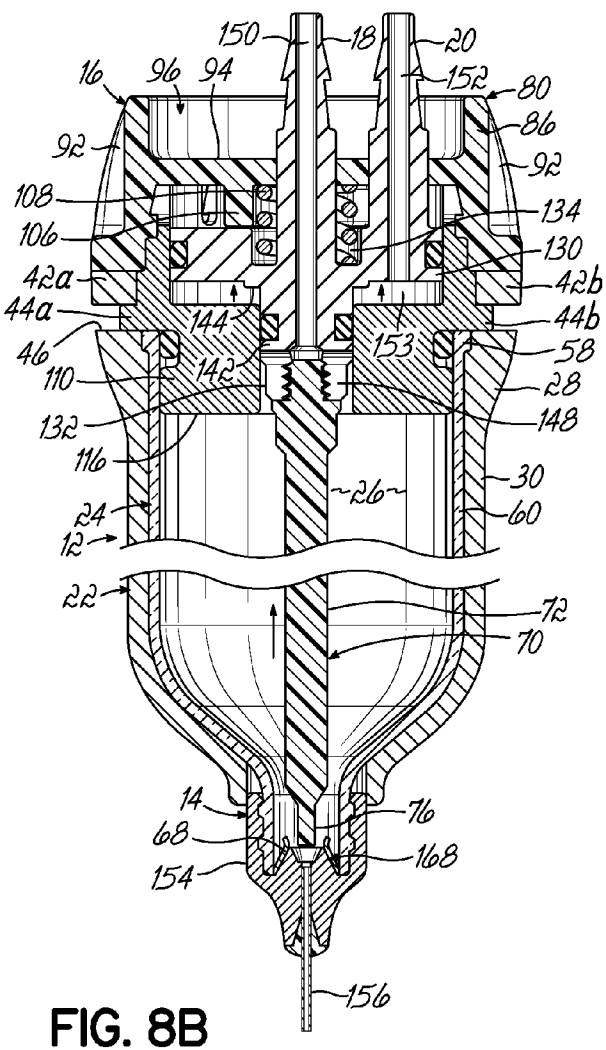
FIG. 8A is a schematic, side cross-sectional view of the handheld valve dispenser of FIG. 1, taken along section line 3-3, showing a valve stem in a lowered closed position for blocking fluid from being dispensed.
FIG. 8B is a schematic, side cross-sectional view similar to FIG. 8A, showing the air piston and the valve stem in a raised open position for dispensing fluid through the dispense tip.

Referring to FIGS. 8A and 8B, operation of the assembled handheld valve dispenser 10 will now be described. The first air inlet fitting 18 is coupled to a first pressurized air supply 180, which may provide a regulated constant-pressure air stream. The second air inlet fitting 20 is coupled to a second pressurized air supply 182, which may provide a pulsed-pressure air stream. The constant-pressure air stream delivered by the first air supply 180 is directed through the first air inlet passage 150, through the stem slot 148 formed in the lower stem portion 132 of the air piston 84, and into the fluid chamber 26, thereby pressurizing the fluid stored in the fluid chamber 26. The pulsed-pressure air stream delivered by the second air supply 182 is directed through the second air inlet passage 152 and into the air chamber 153 for actuating the air piston 84 and the valve member 70 upward.

FIG. 8A shows the valve member 70 and the air piston 84 in a lowered closed position in which the valve tip 76 sealingly contacts the valve seat 178 on the dispense tip 14, thereby blocking fluid from passing into the tip needle 156. The valve member 70 is held in this lowered closed position by the compression spring 108, which exerts a downward compression force on the piston body 130 of the air piston 84. When fluid is to be dispensed, the second air supply 182 is energized to direct a pulse of pressurized air into the air chamber 153, thereby forcing the air piston 84 upward and lifting the valve member 70 into a raised open position in which the valve tip 76 is spaced from the valve seat 178, as shown in FIG. 8B. Upward movement of the air piston 84, and thus of the valve member 70, is limited by the annular inner wall 106, which acts as a valve stroke limiter.

When the valve member 70 is lifted into the raised open position, fluid in the fluid chamber 26 is forced through the pierced liner seal 68 and into the tip needle 156 for dispensing onto a substrate. This dispensing force exerted on the fluid is generated by the constant-pressure air stream delivered by the first air supply 180, which provides the fluid chamber 26 with a generally constant pressurization. Advantageously, this constant pressurization provided by the first air supply 180 improves consistency in fluid volume deposition during dispense, and mitigates irregularities in dispensing performance caused by air entrapped within the fluid.

The duration for which the valve member 70 is held in the raised open position, and thus the volume of fluid that is dispensed, is determined by the time duration of the pulse of pressurized air delivered by the second air supply 182. When the second air supply 182 ceases to deliver the pulse of pressurized air, the compression spring 108 forces the valve member 70, via the air piston 84, back into the lowered closed position, thereby stopping fluid dispense. The second air supply 182 may be controlled to deliver metered pulses of pressurized air in any suitable time intervals and having any suitable durations for actuating the valve member 70 from the lowered closed position to the raised open position. In this manner, the handheld valve dispenser 10 may be operated to dispense fluid droplets, fluid lines, or any combination thereof as desired for a given dispensing operation.

Once a dispensing operation has been completed, the handheld valve dispenser 10 may be disassembled for replacement of the disposable inner barrel liner 24 in preparation for a subsequent dispensing operation. The order of disassembly may be generally opposite of the order of assembly described above. For example, the dispense tip 14 may be decoupled from the distal neck 64 of the disposable inner barrel liner 24, followed by removing the closure 16 and valve member 70 from the barrel 12, followed by removing the disposable inner barrel liner 24 from the outer barrel member 22. The disposable inner barrel liner 24, including the pierced liner seal 68, may then be replaced with a new disposable inner barrel liner 24 having an unpierced, intact liner seal 68. The new disposable inner barrel liner 24 may be filled with a fluid and the handheld valve dispenser 10 may be reassembled in the manner generally described above to perform a subsequent dispensing operation. As described above, the thin-walled structure of the disposable inner barrel liner 24 advantageously allows for easy replacement with minimum costs to the user and minimum waste of materials. Additionally, replacement of the disposable inner barrel liner 24 simplifies the fluid refilling process, and decreases the frequency with which the outer barrel member 22 must be cleaned.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details and representative apparatus and methods shown and described. Accordingly, departures may be made from such details without departing from the scope of the general inventive concept.

What is claimed is:

1. A handheld valve dispenser for dispensing a fluid, the dispenser comprising:

a barrel including a proximal end, a distal end having a seal, and a fluid chamber extending between the proximal end and the distal end and adapted to store the fluid;

a dispense tip coupled to the distal end of the barrel and including a piercing element and a valve seat, the piercing element configured to pierce the seal and establish an aperture therethrough when the dispense tip is first coupled to the barrel; and a valve stem received within the fluid chamber and movable between a closed position in which the valve stem sealingly contacts the valve seat to prevent the fluid from being dispensed and an open position in which the valve stem is spaced from the valve seat to allow the fluid to be dispensed through the dispense tip.

2. The handheld valve dispenser of claim 1, wherein the seal includes a membrane.

3. The handheld valve dispenser of claim 1, wherein the dispense tip further includes a tip hub, the piercing element and the valve seat being provided on the tip hub.

4. The handheld valve dispenser of claim 1, wherein the piercing element includes a tapered portion configured to maintain the aperture in the seal when the dispense tip is coupled to the barrel.

5. The handheld valve dispenser of claim 1, wherein the valve seat is formed on the piercing element.

6. The handheld valve dispenser of claim 1, wherein one of the dispense tip and the barrel includes at least one radial projection and the other of the dispense tip and the barrel includes at least one radial depression that engages the at least one radial projection when the dispense tip is coupled to the barrel to hinder relative rotation between the dispense tip and the barrel.

7. The handheld valve dispenser of claim 1, wherein the barrel includes an outer barrel member and a disposable inner barrel liner received within the outer barrel member.

8. The handheld valve dispenser of claim 7, wherein the disposable inner barrel liner is formed of a blow-molded plastic material.

9. A dispense tip for use with a handheld valve dispenser including a barrel having a proximal end, a distal end having a seal, a fluid chamber extending between the proximal end and the distal end, and a valve stem movable within the fluid chamber between a closed position to prevent a fluid from being dispensed and an open position to allow the fluid to be dispensed through the dispense tip, the dispense tip comprising:

a piercing element configured to pierce the seal and establish an aperture therethrough when the dispense tip is first coupled to the barrel;

a valve seat configured to sealingly contact the valve stem in the closed position; and a tip needle configured to dispense the fluid.

10. The dispense tip of claim 9, further comprising:

a tip hub coupleable to the distal end of the barrel, wherein the piercing element, the valve seat, and the tip needle are provided on the tip hub.

11. The dispense tip of claim 9, wherein the piercing element includes a tapered portion configured to maintain the aperture in the seal when the dispense tip is coupled to the barrel.

12. The dispense tip of claim 9, wherein the valve seat is formed on the piercing element.

13. The dispense tip of claim 9, wherein the dispense tip includes at least one of a radial projection or a radial depression adapted to engage a corresponding at least one of a radial depression or a radial projection on the barrel when the dispense tip is coupled to the barrel to hinder relative rotation between the dispense tip and the barrel.

14. A handheld valve dispenser for dispensing a fluid, the dispenser comprising:

a disposable barrel liner having a proximal end, a distal end having a seal, and a fluid chamber extending between the proximal end and the distal end and adapted to store the fluid and to receive a valve stem; and a dispense tip coupleable to the disposable barrel liner and including:

a piercing element configured to pierce the seal and establish an aperture therethrough when the dispense tip is first coupled to the disposable barrel liner, and a valve seat provided on the piercing element and configured to sealingly contact a valve stem.

15. The handheld valve dispenser of claim 14, wherein the dispense tip further includes a tip hub, the piercing element being provided on the tip hub.

16. The handheld valve dispenser of claim 14, wherein the piercing element includes a tapered portion configured to maintain the aperture in the seal when the dispense tip is coupled to the disposable barrel liner.

17. The handheld valve dispenser of claim 14, wherein the disposable barrel liner is configured to be received within an outer barrel member, and wherein the dispense tip includes at least one of a radial projection or a radial depression adapted to engage a corresponding at least one of a radial depression or a radial projection on the outer barrel member when the dispense tip is coupled to the disposable barrel liner to hinder relative rotation between the dispense tip and the outer barrel member.

18. The handheld valve dispenser of claim 14, wherein the seal includes a membrane.

19. The handheld valve dispenser of claim 14, wherein the disposable barrel liner is formed of a blow-molded plastic material.

20. A handheld valve dispenser for dispensing a fluid, the dispenser comprising:

a barrel having a proximal end, a distal end, and a fluid chamber extending between the proximal end and the distal end and adapted to store the fluid;

a valve stem received within the fluid chamber and movable between a closed position in which the valve stem contacts a valve seat positioned proximate the distal end of the barrel to prevent the fluid from being dispensed, and an open position in which the valve stem is spaced from the valve seat to allow the fluid to be dispensed;

a closure releasably coupled to the proximal end of the barrel;

a first air inlet housed within the closure and configured to receive air for pressurizing the fluid chamber;

a second air inlet housed within the closure and configured to receive air for actuating the valve stem between the closed position and the open position an air chamber; and an air piston coupled to the valve stem and movable within the air chamber to move the valve stem between the closed position and the open position, wherein the first air inlet communicates with the fluid chamber and the second air inlet communicates with the air chamber, and wherein the first air inlet and the second air inlet are coupled to the air piston.

21. The handheld valve dispenser of claim 20, wherein the closure includes a closure base and a closure cap coupled to the closure base, and the air chamber is defined by the closure base.

22. The handheld valve dispenser of claim 20, wherein the barrel includes an outer barrel member and a disposable inner barrel liner received within the outer barrel member, the disposable inner barrel liner defining the fluid chamber.

23. A method of assembling a handheld valve dispenser configured to dispense a fluid and including a barrel having a distal end provided with a seal and the barrel defining a fluid chamber adapted to store the fluid, a dispense tip having a piercing element and a valve seat, and a valve member having a valve stem, the method comprising:

inserting the valve member into the fluid chamber of the barrel;

coupling the dispense tip to the distal end of the barrel;

piercing the seal with the piercing element to establish an aperture through the seal; and sealingly contacting the valve seat with the valve stem.

24. The method of claim 23, wherein the piercing element includes a tapered portion, the method further comprising:

maintaining the aperture in the seal with the tapered portion.

25. The method of claim 23, wherein the valve seat is provided on the piercing element, and sealingly contacting the valve seat with the valve stem includes contacting the piercing element.

26. The method of claim 23, wherein the dispense tip includes at least one of a radial projection or a radial depression and the barrel includes a corresponding at least one of a radial depression or a radial projection, the method further comprising:

engaging the at least one of a radial projection or a radial depression on the dispense tip with the corresponding at least one of a radial depression or a radial projection on the barrel to hinder relative rotation between the dispense tip and the barrel.

27. The method of claim 23, further comprising:

filling the fluid chamber of the barrel with the fluid;

sealingly contacting the valve seat with the valve stem to prevent the fluid from being dispensed; and moving the valve stem to a position spaced from the valve seat to allow the fluid to be dispensed through the dispense tip.

28. A method of assembling a handheld valve dispenser including a disposable barrel liner having a distal end provided with a seal and defining a fluid chamber adapted to store a fluid and adapted to receive a valve stem, the handheld valve dispenser further including a dispense tip having a piercing element and a valve seat provided on the piercing element, the method comprising:

coupling the dispense tip to the distal end of the disposable barrel liner to:

pierce the seal with the piercing element to establish an aperture through the seal; and position the piercing element through the aperture such that the valve seat is positioned to sealingly contact the valve stem; and maintaining the aperture through the seal so that the fluid in the fluid chamber may be dispensed through the dispense tip when the valve stem is provided in an open position.

29. The method of claim 28, wherein the piercing element includes a tapered portion, and maintaining the aperture through the seal includes supporting the pierced seal with the tapered portion.

30. The method of claim 28, wherein the disposable barrel liner includes a first thread and the dispense tip includes a second thread, and piercing the seal with the piercing element is accomplished by threadedly engaging the first thread with the second thread.

31. The method of claim 28, wherein the seal includes a membrane, and piercing the seal includes piercing the membrane.

32. A method of dispensing a fluid with a handheld valve dispenser including a barrel having a fluid chamber adapted to store the fluid and a distal end provided with a seal, a valve stem, a dispense tip having a piercing element and a valve seat, a first air inlet, and a second air inlet, the method comprising:

filling the fluid chamber with the fluid;

coupling the dispense tip to the barrel to:

pierce the seal with the piercing element to establish an aperture through the seal; and provide the valve stem in a closed position in which the valve stem sealingly contacts the valve seat to prevent the fluid from being dispensed;

receiving air through the first air inlet for pressurizing the fluid chamber;

receiving air through the second air inlet for actuating the valve stem to an open position in which the valve stem is spaced from the valve seat; and dispensing the fluid while the valve stem is in the open position.

33. The method of claim 32, wherein receiving air through the first air inlet includes receiving a stream of air having a substantially constant pressure.

34. The method of claim 32, wherein receiving air through the second air inlet includes receiving a stream of air having a pulsed pressure.

35. The method of claim 32, wherein the handheld valve dispenser defines an air chamber, and further comprises an air piston movable within the air chamber and coupled to the valve stem, wherein actuating the valve stem to the open position includes directing the air received through the second air inlet into the air chamber to actuate the air piston.

36. A handheld valve dispenser for dispensing a fluid, the dispenser comprising:

a disposable barrel liner having a proximal end, a distal end having a seal, and a fluid chamber extending between the proximal end and the distal end and adapted to store the fluid and to receive a valve stem; and a dispense tip coupleable to the disposable barrel liner and including a piercing element configured to pierce the seal and establish an aperture therethrough when the dispense tip is first coupled to the disposable barrel liner, wherein the disposable barrel liner is configured to be received within an outer barrel member, and wherein the dispense tip includes at least one of a radial projection or a radial depression adapted to engage a corresponding at least one of a radial depression or a radial projection on the outer barrel member when the dispense tip is coupled to the disposable barrel liner to hinder relative rotation between the dispense tip and the outer barrel member.

37. The handheld valve dispenser of claim 36, wherein the dispense tip further includes a tip hub, the piercing element being provided on the tip hub.

38. The handheld valve dispenser of claim 36, wherein the piercing element includes a tapered portion configured to maintain the aperture in the seal when the dispense tip is coupled to the disposable barrel liner.

39. A handheld valve dispenser for dispensing a fluid, the dispenser comprising:

a barrel having a proximal end, a distal end, and a fluid chamber extending between the proximal end and the distal end and adapted to store the fluid;

a valve stem received within the fluid chamber and movable between a closed position in which the valve stem contacts a valve seat positioned proximate the distal end of the barrel to prevent the fluid from being dispensed, and an open position in which the valve stem is spaced from the valve seat to allow the fluid to be dispensed;

an air chamber defined by the dispenser;

an air piston coupled to the valve stem and movable within the air chamber to move the valve stem between the closed position and the open position;

a first air inlet communicating with the fluid chamber, and configured to receive air for pressurizing the fluid chamber; and a second air inlet communicating with the air chamber, and configured to receive air for actuating the air piston to move the valve stem between the closed position and the open position wherein the first air inlet and the second air inlet are coupled to the air piston.

* * * * *